US009968178B2

(12) United States Patent
Frazer et al.

(10) Patent No.: US 9,968,178 B2
(45) Date of Patent: May 15, 2018

(54) HAMMOCK WITH INSECT NETTING

(71) Applicants: Thomas Frazer, Scottsdale, AZ (US); Mark Gruskin, Tucson, AZ (US)

(72) Inventors: Thomas Frazer, Scottsdale, AZ (US); Mark Gruskin, Tucson, AZ (US)

(73) Assignee: HAMMOCK BLISS, PTY LTD, Dover Heights, New South Wales ( * ) Notice: Subject to any disclaimer, the term of this patent is extended or adjusted under 35 U.S.C. 154(b) by 191 days.

(21) Appl. No.: 15/008,065

(22) Filed: Jan. 27, 2016

(65) Prior Publication Data

US 2016/0213131 A1 Jul. 28, 2016

Related U.S. Application Data

(60) Provisional application No. 62/108,342, filed on Jan. 27, 2015.

(51) Int. Cl.
*A45F 3/22* (2006.01)
*A45F 3/52* (2006.01)

(52) U.S. Cl.
CPC . *A45F 3/22* (2013.01); *A45F 3/52* (2013.01)

(58) Field of Classification Search
CPC ..... A45F 3/22
USPC ..... 5/120–122
See application file for complete search history.

(56) References Cited

U.S. PATENT DOCUMENTS

| | | | | |
|---|---|---|---|---|
| 955,281 | A * | 4/1910 | Norwood | A45F 3/22 5/121 |
| 4,071,917 | A | 2/1978 | Mojica | |
| 4,320,542 | A | 3/1982 | Cohen | |
| 5,115,525 | A | 5/1992 | Lovitt | |
| 5,913,772 | A | 6/1999 | Clark | |
| 6,851,137 | B2 | 2/2005 | Hennessy | |
| 6,865,757 | B2 | 3/2005 | Hennessy | |
| 7,699,068 | B2 | 4/2010 | Helsdon | |
| 8,161,991 | B2 | 4/2012 | Johnson | |
| 2011/0010849 | A1 | 1/2011 | Lemmens | |
| 2012/0005827 | A1 | 1/2012 | Clark et al. | |

FOREIGN PATENT DOCUMENTS

| | | |
|---|---|---|
| WO | 2007073920 | 7/2007 |

* cited by examiner

*Primary Examiner* — Fredrick C Conley
(74) *Attorney, Agent, or Firm* — Gearhart Law LLC

(57) ABSTRACT

The present disclosure provides for a sleep apparatus with a base having an asymmetric design, featuring an integrated sleeve such that a pad may be inserted into the sleeve. The sleep apparatus may also have a net that provides for an enclosure. The asymmetric design of the base and the pad that fits into the integrated sleeve provide for a substantially flat surface for a user to lie on while using this sleep apparatus. This substantially flat surface creates a more-uniform pressure against a user's body allowing for the sleep apparatus to be comfortably resided-in for longer periods of time when compared with a traditional hammock. The net of the present invention creates a means for suspending the insect net above a user. The sleep apparatus may be optionally equipped with a storage pouch.

20 Claims, 6 Drawing Sheets

HAMMOCK WITH INSECT NETTING

CLAIM OF PRIORITY

This application claims priority to U.S. Application Ser. No. 62/108,342 filed on Jan. 27, 2015, the contents of which are fully incorporated herein by reference in its entirety.

FIELD OF THE EMBODIMENTS

The invention and its embodiments relate to sleeping apparatuses, namely hammocks. In particular the present invention and its embodiments relate to a hammock having a base with an asymmetrical design as well as dense netting to provide restful sleep and protection from insects and the like.

BACKGROUND OF THE EMBODIMENTS

A hammock is a sling made of rope, fabric, netting, or the like that is suspended between and attached to two points. Hammocks were originally used in Central and South America, but have advanced with the times, and are now prevalent in today's society. Hammocks are typically designed for one of two different types of users: 1) those designed for leisure users and 2) those designed for outdoor enthusiasts. The hammocks built for the "outdoor enthusiast" combine the use of modern technology including netting, protections from the elements, and lightweight materials. However, even with these modern advances, the current hammocks still leave much to be desired.

A common issue with current hammock designs is the disproportionate pressure placed on the back of a user's knees and shoulders. This non-uniform pressure is a result of the hammock's sling being generally wider towards the middle of the sling and narrower at the attached ends of the sling. Additionally, when suspended, hammocks traditionally bear a general 'U' shape, further exacerbating this problem of non-uniform pressure. These characteristics lead to the aforementioned issues with a user's knees and shoulders and contribute to the general discomfort that occurs after using a hammock for an extended period of time.

As noted above, hammocks may be equipped with netting that will shield a user from insects. However, existing hammocks equipped with insect nettings have drawbacks as to the manner of attaching the netting. For example, in the past, insect nettings have been permanently affixed to the periphery of the hammock while maintaining a resealable entrance area. However, a user moving back and forth through the resealable entrance area inevitably places undue strain on the netting, which can cause separation between the hammock and netting. This separation breaks the insect-impermeable shield, defeating the entire purpose of the incorporation of the net. Further, the mere movement of a user within the hammock causes undue strain the attachment means of insect nettings taught by the prior art.

Thus, there is a need for a hammock that generates more-uniform pressure across the body of a user, allowing it to be used comfortably for long periods of time. Further, there is a need for a hammock with an insect netting that allows a user to move or shift their weight while using the hammock without causing undue strain on the netting. Moreover, these goals must all be accomplished without sacrificing the lightweight and durable nature of traditional hammocks. The present invention and its embodiments meets and exceed these objectives.

Review of Related Technology:

U.S. Pat. No. 6,865,757 pertains to a hammock that includes a bed made of a piece of flexible material gathered by folding it at its opposite ends. The hammock is suspended by ropes that are attached to the gathered ends, wherein the ropes are tied to nearby trees. The edges of the bed are drawn apart along a tension axis which is diagonal to the suspension axis, giving the bed the shape of a non-equilateral polygon so that one can lie diagonally across the suspension axis, whereby the back is well supported.

U.S. Pat. No. 4,320,542 pertains to a portable, suspended outdoor shelter that includes a base panel having a pair of stiffening members secured by a pair of sleeves disposed along opposed longitudinally extending sides of the base panel. A pair of reinforcing web members extend along and reinforce the sleeves while extended substantially beyond those sleeves sot that they may be secured to a pair of spaced apart support structures. A plurality of resilient, linear tubular members are bent in an inverted U configuration and are secured above and between the stiffening members to apply tension laterally to the base panel. End panels extend between the ends of the base panel and the lower portions of their respective reinforcing web member. There exist a window and a door disposed in each end panel. A canopy extends between the upper edges of the end panels, and is supported by the inverted U tubular members. The base, end panels, and canopy define an enclosed shelter which is suspended above the ground between two support structures, securing a user from the elements and ground-dwelling creatures.

U.S. Patent Application 2011/0010849 pertains to a hammock design which provides increased support in its medial portion via a combination of wide bands of fabric situated in a lengthwise X-shaped formation with a curved or bent spreader bar. Preferably, the spreader bar rises from a lower middle part toward higher raised ends. This hammock provides a user with comfortable positioning with nearly horizontal transverse support at the users shoulders and while orienting the user a nearly level position from head to toe.

Various devices are known in the art. However, their structure and means of operation are substantially different from the present disclosure. Such hammocks fail to relieve the pressure placed on muscles and joints. In turn, the other inventions fail to solve all the problems taught by the present disclosure. The present invention and its embodiments provide for a design which enables the hammock to lay substantially flatter, or horizontal, than in the traditional "U" shape of hammocks. At least one embodiment of this invention is presented in the drawings below and will be described in more detail herein.

SUMMARY OF THE EMBODIMENTS

The present disclosure provides for a sleeping apparatus, comprising: a hammock portion, comprising: a pair of support cords each having a first and second end; a suspension cord having a first and second end; a middle panel that is substantially rectangular in shape, wherein said middle panel is equipped with an integrated sleeve adapted to receive a support pad; a first longitudinal panel that is substantially triangular in shape, wherein the first longitudinal panel shares at least one common edge with the middle panel; a second longitudinal panel that is substantially triangular in shape, wherein the second longitudinal panel shares at least one common edge with the middle panel; a first lateral panel that is substantially triangular in shape, wherein the first lateral panel shares at least one common edge with the middle panel; wherein the shared common edge is reinforced with webbing; a second lateral panel that is substantially triangular in shape, wherein the second lateral panel shares at least one common edge with the middle panel; wherein the shared common edge is reinforced with webbing; a first support panel that is substantially triangular in shape, wherein the first support panel shares at least one common edge with the first longitudinal panel and at least one common edge with the first lateral panel; wherein the shared common edge is reinforced with webbing; a second support panel that is substantially triangular in shape, wherein the second support panel shares at least one common edge with the second longitudinal panel and at least one common edge with the second lateral panel; wherein the shared common edge is reinforced with webbing; a first and second receiving portions, wherein said first receiving portion is attached to at least one edge of the first support panel and is capable of receiving a means for suspending the sleep apparatus, wherein said second receiving portion is attached to at least one edge of the support second panel and is capable of receiving a means for suspending the sleep apparatus; and a net portion, comprising: a fabric lattice, at least one suspension hole, wherein said net is stitched to the first and second support panels, said net being gathered at one end proximate to an edge of the first support panel and secured with one gathering loop to create a seal at said gathering, said net being gathered at another end with the open end of the left panel and secured with another gathering loop, such that a seal is effectively created at said gathering; said suspension cord is brought through the suspension hole such that the net is suspended above a user, wherein one support cord has one end affixed to the gathering of the net and the first support panel; and wherein one support cord has one end affixed to the gathering of the net and the second support panel.

The present invention comprises a sleeping apparatus (hammock) that provides for improved comfort when compared to a traditional hammock. This is achieved via two mechanisms. The first is the asymmetrical shape of the base of the present invention. This asymmetrical shape allows for a user's weight to be distributed more evenly by placing the bulk of the user's weigh along the axis created by a line drawn from the two points of suspension of the present invention. The second mechanism is through the use of a support pad being inserted into an integrated sleeve. The support pad creates a flatter surface when compared with the 'U' shape of a traditional hammock. This flatter surface which eases the strain placed on a user's shoulders, allowing for the present invention to be comfortably resided in for a longer period of time than a traditional hammock. It should be noted that while preferable, it is not necessary to have an inflatable pad to utilize the present invention.

Further, the present invention also provides for insect netting incorporated into the structure of the base of the present invention such that a user will be protected from insect bites. The present invention also contains an improved stitching means such that a user moving around while in the hammock will generate less strain in the fabric that comprises the hammock and insect net. In a preferred embodiment, the present invention is equipped with a travel pack. This travel pack allows the hammock to be conveniently stored while travelling and will double as a gear bag while the present invention is in use. Further, the present invention may be optionally equipped with pockets, extra gear loops, and cord loops at the end of the hammock.

In general, the present invention succeeds in conferring the following, and others not mentioned, benefits and objectives.

It is an object of the present invention to provide a hammock that may be packed up and carried easily.

It is an object of the present invention to provide a hammock that is lightweight and durable.

It is an object of the present invention to provide a hammock that provides greater support than a traditional hammock.

It is an object of the present invention to provide a hammock that contains an insect net that can be easily deployed.

It is an object of the present invention to provide a hammock that provides some insulation.

It is an object of the present invention to provide a hammock that exerts more-uniform pressure on a user.

DESCRIPTION OF THE PREFERRED EMBODIMENTS

Figure 1:
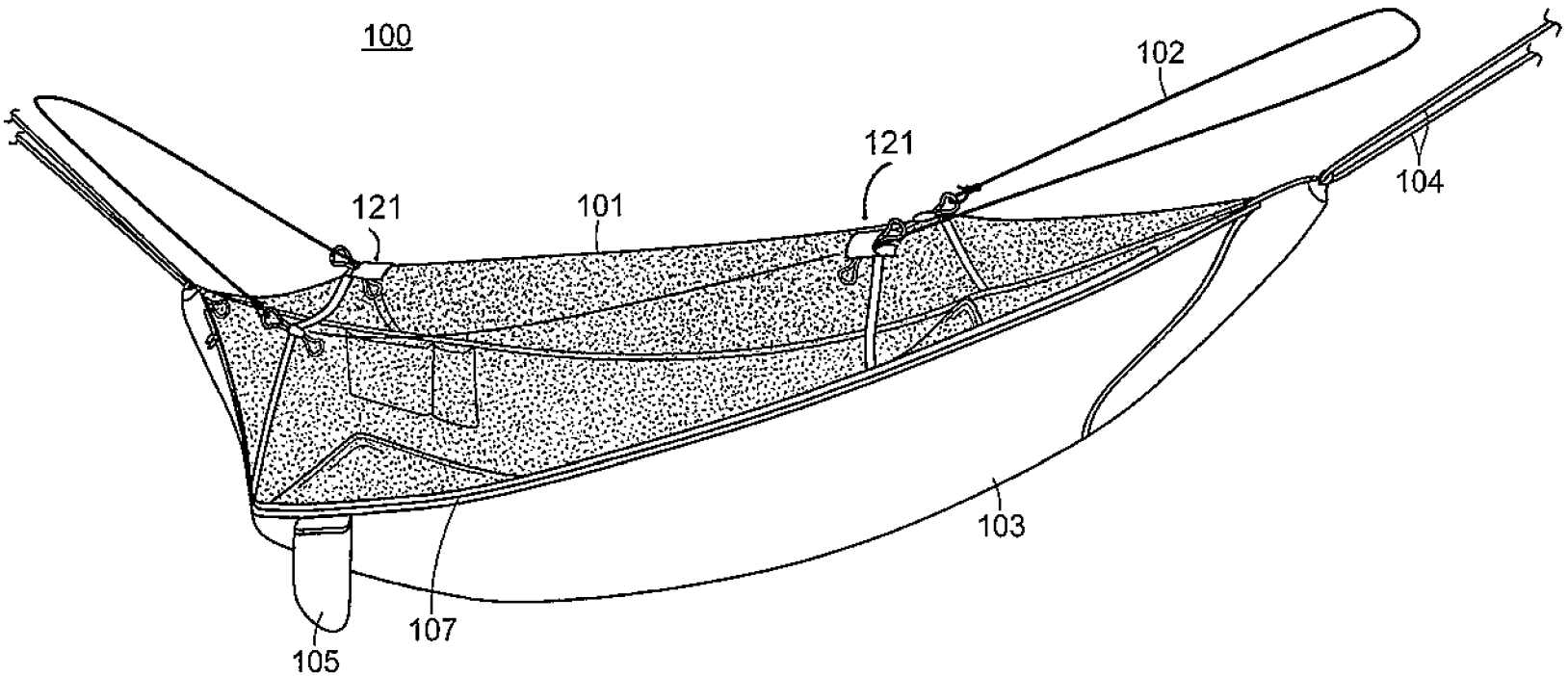
FIG. 1 is a perspective view of an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring to FIG. 1, a perspective view of an embodiment of the invention is shown. This view shows an embodiment of the invention while in use. Specifically, sleeping apparatus 100 is comprised of net 101, a plurality of suspension cords 102, base 103, a plurality of support cords 104, a plurality of gear loops 121, and zipper seam 107. In a preferred embodiment, sleeping apparatus 100 is optionally equipped with storage pouch 105. In another preferred embodiment, net 101 has a density of at least 2000 holes per square inch, preferably at least 2100 holes per square inch. Nets of this density serve as an effective barrier against all manner of insects, including ceratopogonidae, colloquially known as "no see ums." Suspension cords 102 serve to keep net 101 taught such that when zipper seam 107 is engaged, there exists a space for a user to relax in a bug-free space in the area between base 103 and net 101. When equipped, storage pouch 105 provides a means to easily carry sleeping apparatus 100 when not in use. This makes sleeping apparatus 100 particularly well-suited for use while hiking, and performing other outdoor activities. Plurality of gear loops 121 provide a means for a user to hang gear outside of the enclosure created by base 103 and net 101. In a preferred embodiment, plurality of gear loops 121 will extend into the enclosure, allowing a user to hang and access items from within the enclosure.

Figure 2:
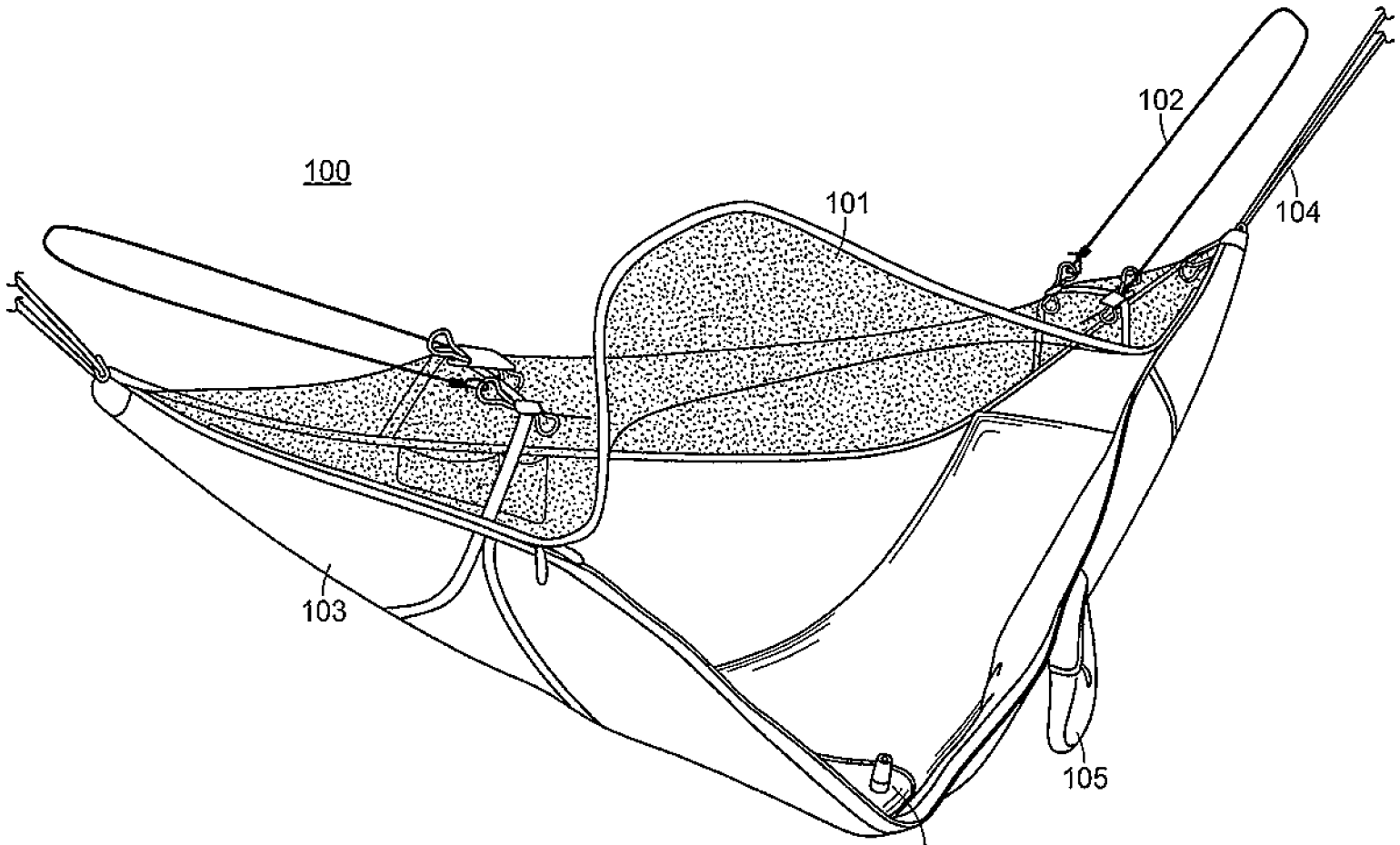
FIG. 2 is a side view of an embodiment of the invention, highlighting the detachable nature of the net of the present invention.

Referring to FIG. 2, a side view of an embodiment of the invention is shown. Specifically, sleeping apparatus 100 is displayed, highlighting a number of features. One such feature, is the ability of net 101 and base 103 to be separated along zipper seam 107 so that a user may easily enter sleeping apparatus 100. Additionally, in a preferred embodiment, sleeping apparatus 100 is optionally equipped with pad 108. Pad 108 provided additional support for a user resting in sleeping apparatus 100. Further, pad 108 provides insulation for a user, allowing sleeping apparatus 100 to be used in a wider range of climates.

Figure 3:
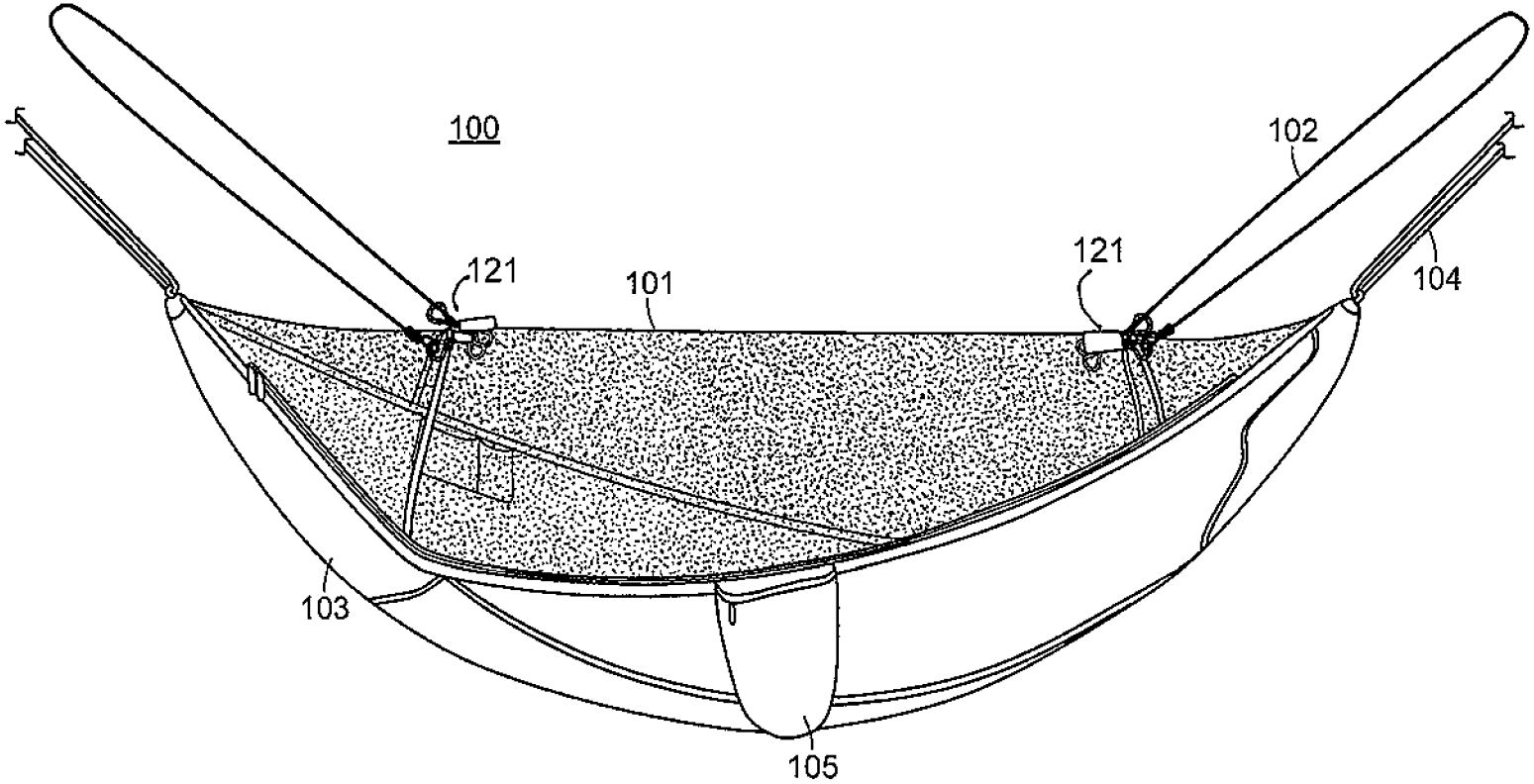
FIG. 3 is a side view of an embodiment of the present invention.

Referring to FIG. 3, a side view of an embodiment of the present invention in shown. This view shows an embodiment of the present invention while suspended. Of note here is how plurality of gear loops 121 is used to support suspension cord 102 while extending into the enclosure between net 101 and base 103 to provide for additional loops for gear to be attached to.

Figure 4:
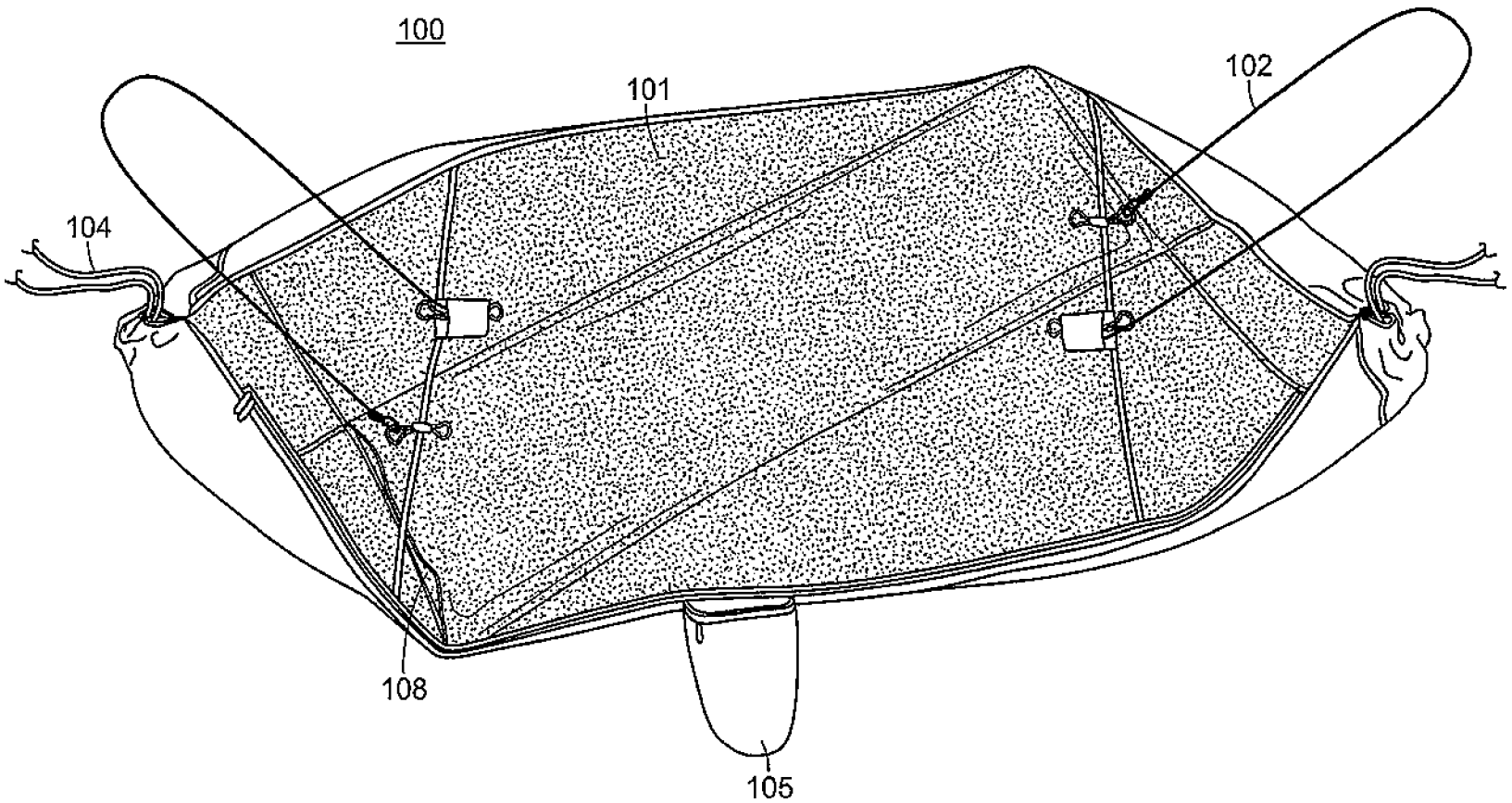
FIG. 4 is a top view of an embodiment of the present invention.

Referring to FIG. 4, a top view of an embodiment of the invention is shown. This view highlights the asymmetrical nature of the present invention. Specifically, FIG. 4 shows how sleeping apparatus 100 is shaped so that a user may enjoy a substantially flat sleeping experience while being suspended in the air. Additionally, the location of pad 108 is shown in relation to the entirety of this preferred embodiment of sleeping apparatus 100. This functionality is intended to greatly increase the ease of insertion of pad 108.

Figure 5:
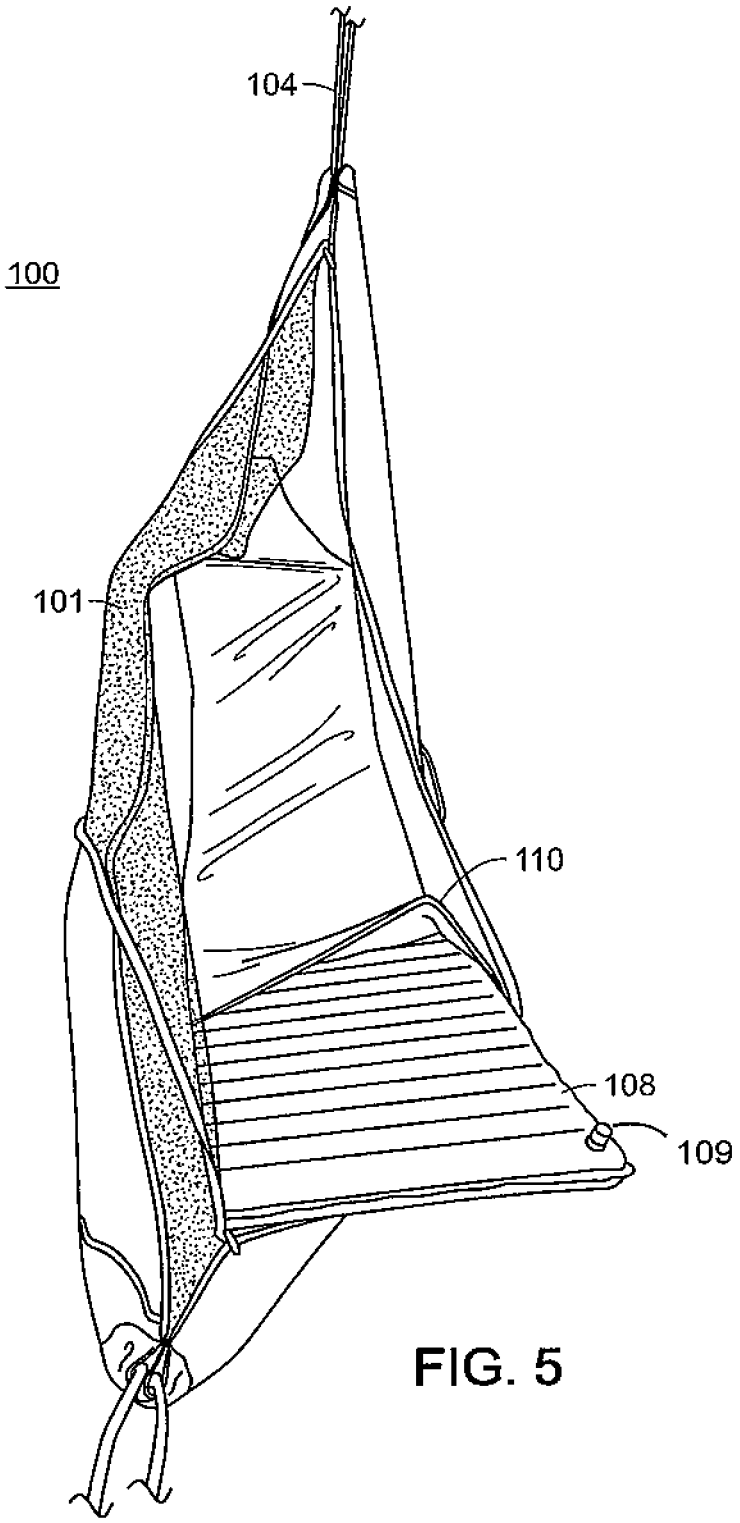
FIG. 5 is a front view of an embodiment of the present invention, highlighting the pad.

Referring to FIG. 5, a front view of an embodiment of the present invention is provided. This view highlights how pad 108 interfaces with the present invention. As can be seen, pad 108 slides directly into integrated sleeve 110. In a preferred embodiment, pad 108 is inflatable, and contains air valve 109. By having air valve 109 located within the area enclosed by base 103 and net 101, a user is able to first slide an uninflated pad 108 into base 103 and subsequently inflate said pad 108. This can assist with the insertion of pad 108 into integrated sleeve 110.

Figure 6:
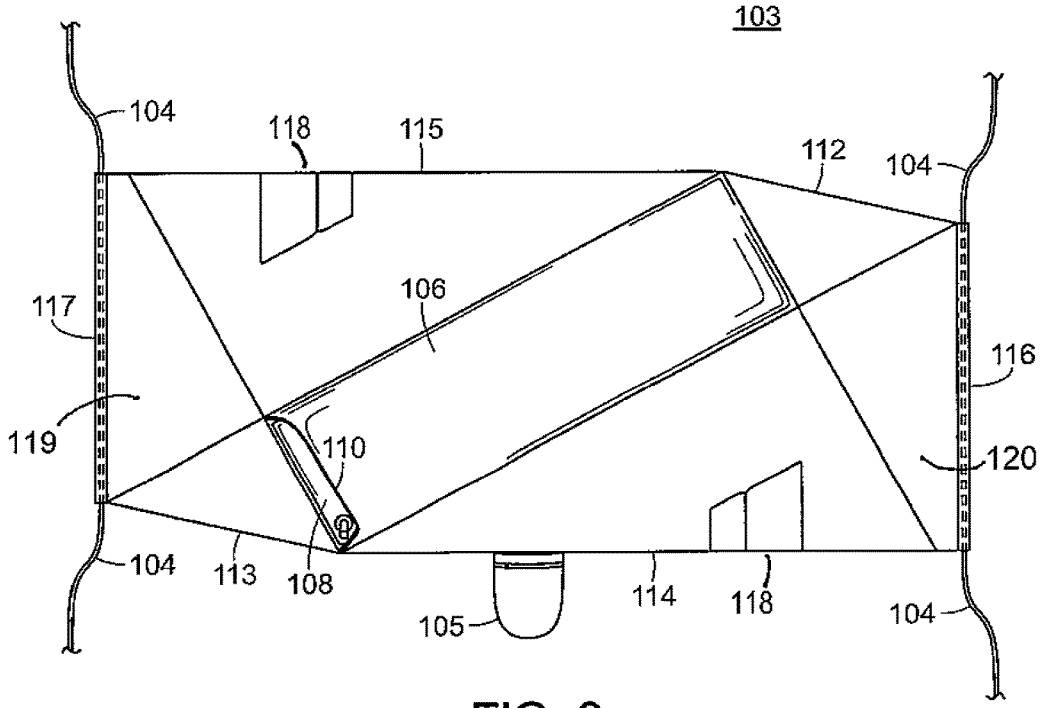
FIG. 6 is top view of an embodiment of the present invention, highlighting the composition of the base of the invention.

Referring to FIG. 6, a top view of an embodiment of the present invention is provided for. Specifically, this view highlights the asymmetrical nature of base 103. Due in part to this asymmetrical shape, when in use, sleeping apparatus 100 is substantially more planar than a traditional hammock. In a preferred embodiment, base 103 is equipped with pad 108 or some other pad inside of integrated sleeve 110 to provide further rigidity in base 103. Here, a top view of base 103 of sleeping apparatus 100 laid flat is shown. In a preferred embodiment, base 103 is comprised of middle panel 106, first longitudinal panel 114, second longitudinal panel 115, first support panel 112, second support panel 113, first lateral panel 120, and second lateral panel 121. In another preferred embodiment, base 103 is equipped with a plurality of internal pockets 118. In yet another preferred embodiment, base 103 is equipped with first base support receiving member 116, and second base support receiving member 117. First and second base support receiving members 116 and 117, when used in conjunction with base suspension cord 104 provide a mechanism to allow base 103 to be suspended. It should be noted that while this embodiment is comprised of 7 different panels, it is possible to construct the present invention out of three panels. For example, first support panel 112, second longitudinal panel 115 and first lateral panel 119 can be combined to make a single panel. In an alternative embodiment, second longitudinal panel 115, middle panel 106, and first longitudinal panel 114 could be combined to create a single panel.

In one embodiment, first and second longitudinal panels 114 and 115 are each connected to at least one edge of middle panel 106. In that same embodiment, first and second lateral panels 119 and 120 are each connected to at least one edge of the middle panel, and first and second support panels 112 and 113 are also each connected to at least one edge of the neighboring longitudinal and lateral panels. In one embodiment first and second base support receiving members 116 and 117 are optionally omitted from the invention. In alternative embodiments first and second base support receiving portions 116 and 117 are attached to the edges of first and second support panels 112 and 113 that are not shared with an adjacent panel. It should be noted that while preferable, it is not necessary to have an inflatable pad to utilize the present invention.

It should be noted that the relative size and shape of the middle panel 106, first and second longitudinal panels 114 and 115, first and second lateral panels 103 and 109, and support panels 104 and 108 shown in FIG. 1 are meant to be illustrative of one embodiment of the invention, but other embodiments wherein the panels deviate from the exact proportions of FIG. 1.

In a preferred embodiment, the present invention has a total length of approximately 320 cm, where the zippers on the invention extend approximately 280 cm with 20 cm on either side of the zipper being sewn shut. Further, the netting is able to be opened fully and folder over the top of the hammock portion of the present invention. In a preferred embodiment, the hammock has zippers to make it easy to get in and out of the present invention. Double pull YKK zippers are the desired component for these zippers, but alternative zippers may also be used. In an alternative embodiment, said netting may be attached to the entire perimeter of the hammock portion of the present invention. This provides the additional benefit of making the present invention reversible.

In yet another preferred embodiment, net 101 is not attached to first lateral panel 119 nor second lateral panel 120. This allows less netting to be used, resulting in the present invention being lighter. Further, the space created by not attaching the net to first lateral panel 119 nor second lateral panel 120 is closed when support cord 104 is gathered at the ends and a knot is used to tie support cord 104 off.

Additionally, pad 108 may be secured by a fold over flap to keep the pad in place. That is, a flap of fabric where pad 108 may be inserted and then excess material may be folded over the top to have pad 108 retain its position.

It should be noted that in the vast majority of the numerous embodiments of the invention, that the panels are secured by reinforced webbing. In an alternative embodiment, all of the seams of the present invention are reinforced by webbing. In yet another alternative embodiment, the seams may not be reinforced at all.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the disclosure refers to exemplary embodiments, it will be understood by those skilled in the art that various changes may be made and equivalents may be substituted for elements thereof without departing from the scope of the disclosure. In addition, many modifications will be appreciated by those skilled in the art to adapt a particular instrument, situation or material to the teachings of the disclosure without departing from the spirit thereof. Therefore, it is intended that the disclosure not be limited to the particular embodiments disclosed.

What is claimed is:

1. A sleeping apparatus, comprising:

a middle panel, having a first side and a second side;

a first panel, being substantially triangular in shape,
wherein said first panel is attached to said first side;

a second panel, being substantially triangular in shape,
wherein said second panel is attached to said second side;

a first receiving portion, attached to said first panel,
wherein said first receiving portion is capable of receiving a cord;

a second receiving portion, attached to said second panel,
wherein said first receiving portion is capable of receiving a cord; and an optionally equipped integrated sleeve,
wherein said integrated sleeve is integrated with said middle panel.

2. The sleeping apparatus of claim 1, further comprising a net enclosure.

3. The sleeping apparatus of claim 2, further comprising a plurality of gear loops.

4. The sleeping apparatus of claim 2, wherein the net has over 2000 holes per square inch.

5. The sleeping apparatus of claim 2, further comprising a pouch sized to receive the sleep apparatus when not in use,
wherein the pouch is attached to the seam between the net and the middle panel.

6. The sleep apparatus of claim 1, further comprising a plurality of gear loops.

7. The sleeping apparatus of claim 1, wherein one end of the integrated sleeve contains a triangular opening.

8. The sleep apparatus of claim 1, wherein the first panel, second panel, and middle panel are comprised of rip stop nylon.

9. The sleep apparatus of claim 8, wherein the pad is inflatable.

10. The sleep apparatus of claim 1, further comprising a pad,
wherein said pad is shaped to be insertable into said integrated sleeve.

11. The sleep apparatus of claim 1, wherein the first panel and second panel are each equipped with at least one storage pocket.

12. The sleep apparatus of claim 11, wherein said plurality of gear loops are situated to provide for a mechanism to hang items within the sleep apparatus.

13. The sleeping apparatus of claim 12, further comprising:

a net portion, comprising:

a fabric lattice, at least one gear loop, wherein said net is stitched to the first and second support panels, said net being gathered at one end proximate to an edge of the first support panel and secured with one gathering loop to create a seal at said gathering, said net being gathered at another end with the open end of the left panel and secured with another gathering loop, such that a seal is effectively created at said gathering;

said suspension cord is brought through the at least one gear loops such that the net is suspended above a user, wherein one support cord has one end affixed to the gathering of the net and the first support panel; and wherein one support cord has one end affixed to the gathering of the net and the second support panel.

14. The sleep apparatus of claim 13, wherein said base comprises a plurality of polygonal panels.

15. The sleep apparatus of claim 13, wherein said base is configured to receive a pad.

16. The sleep apparatus of claim 13, further comprising internal pockets.

17. The sleep apparatus of claim 16, wherein said middle panel is capable of receiving a pad.

18. The sleep apparatus of claim 16, further comprising an attached storage pouch.

19. The sleep apparatus of claim 13, wherein said base comprises:

a middle panel;

a first support panel;

a second support panel;

a first longitudinal panel;

a second longitudinal panel;

a first lateral panel, and a second lateral panel.

20. A sleeping apparatus, comprising:

a hammock portion, comprising:

a pair of support cords each having a first and second end;

a suspension cord having a first and second end;

a middle panel that is substantially rectangular in shape,
wherein said middle panel is equipped with an integrated sleeve adapted to receive a support pad;

a first longitudinal panel that is substantially triangular in shape,
wherein the first longitudinal panel shares at least one common edge with the middle panel;

a second longitudinal panel that is substantially triangular in shape,
wherein the second longitudinal panel shares at least one common edge with the middle panel;

a first lateral panel that is substantially triangular in shape,
wherein the first lateral panel shares at least one common edge with the middle panel;
wherein the shared common edge is reinforced with webbing;

a second lateral panel that is substantially triangular in shape,
wherein the second lateral panel shares at least one common edge with the middle panel;
wherein the shared common edge is reinforced with webbing;

a first support panel that is substantially triangular in shape, wherein the first support panel shares at least one common edge with the first longitudinal panel and at least one common edge with the first lateral panel;

wherein the shared common edge is reinforced with webbing;

a second support panel that is substantially triangular in shape, wherein the second support panel shares at least one common edge with the second longitudinal panel and at least one common edge with the second lateral panel;

wherein the shared common edge is reinforced with webbing;

a first and second receiving portions, wherein said first receiving portion is attached to at least one edge of the first support panel and is capable of receiving a means for suspending the sleep apparatus, wherein said second receiving portion is attached to at least one edge of the support second panel and is capable of receiving a means for suspending the sleep apparatus.

* * * * *